United States Patent [19]

Ueda

[11] 4,181,832

[45] Jan. 1, 1980

[54] BUCKLE APPARATUS FOR SAFETY BELT

[75] Inventor: Takeo Ueda, Fujisawa, Japan

[73] Assignee: NSK-Warner K.K., Tokyo, Japan

[21] Appl. No.: 886,052

[22] Filed: Mar. 13, 1978

[30] Foreign Application Priority Data

| | | | |
|---|---|---|---|
| Apr. 4, 1977 | [JP] | Japan | 52/40987[U] |
| May 6, 1977 | [JP] | Japan | 52/51219 |
| Nov. 9, 1977 | [JP] | Japan | 52/150329[U] |

[51] Int. Cl.[2] ..... H01H 3/16; A44B 11/26

[52] U.S. Cl. ..... 200/61.58 B; 24/230 AL; 362/80; 362/61

[58] Field of Search ..... 24/230 AL; 200/61.58 B

[56] References Cited

U.S. PATENT DOCUMENTS

| | | | |
|---|---|---|---|
| 3,126,227 | 3/1964 | Bollinger | 24/230 AL |
| 3,201,840 | 8/1965 | Jantzen | 24/230 AL |
| 3,737,126 | 6/1973 | Martin | 24/230 AL |
| 3,935,618 | 2/1976 | Fohl | 24/230 AL |
| 4,047,267 | 9/1977 | Lindblad | 24/230 AL |

*Primary Examiner*—Bernard A. Gelak

*Attorney, Agent, or Firm*—Shapiro and Shapiro

[57] ABSTRACT

A buckle apparatus for safety belt assembly, comprises a tongue member provided on opposed side edges with notches, a base plate member having a portion where said tongue member is inserted and being formed on the opposed sides thereof with guide grooves substantially perpendicular to the direction of the tongue insertion, a tongue latching means including a pair of tongue latching members, the tongue latching members being slidable along the respective guide grooves of the base plate member in a direction to substantially perpendicular to the direction of the tongue insertion, means for biasing said tongue latching members so that the tongue latching members may engage the respective notches of the tongue member, when the tongue member is inserted into the base plate member, to latch the tongue member, and operable means including cam portions for moving said tongue latching members against the force of said biasing means to unlatch the tongue member.

11 Claims, 6 Drawing Figures

BUCKLE APPARATUS FOR SAFETY BELT

BACKGROUND OF THE INVENTION

1. Field of the Invention

The present invention relates to a buckle for safety belt adapted for use principally in vehicles, and more particularly to such a buckle as provided with slidable latching members.

2. Description of the Prior Art

There have been known similar buckles of various structures, but such known buckles are unsatisfactory in failing to achieve both adequate resistance to an elevated load and easy release, in possible deformation in loaded state or insufficient strength due to the use of a roller as the latching member, and also in difficulty associated with the easy manipulation of the buckle.

SUMMARY OF THE INVENTION

A first object of the present invention is to provide a buckle for safety belt capable of withstanding an elevated load and allowing smooth release.

A second object of the present invention is to provide a buckle for safety belt which has substantial latch strength and in which the latching members will not deform.

A third object of the present invention is to provide a buckle for safety belt allowing easy manipulation.

According to the present invention, the above-mentioned first objective is achieved by a buckle comprising a housing provided with a tongue-receiving pocket, latching members biased in a direction perpendicular to the longitudinal central axis of the tongue-receiving pocket, a base member movably supporting the latching members, a tongue, and a tongue releasing means.

The above-mentioned second objective is achieved by providing an integral structure for the base member in the form of a single piece of metal plate folded to form two layers in the slide path of the latching members.

The above-mentioned third objective is attained by providing the above-mentioned latching members and also providing an illuminating means on such a buckle apparatus.

DESCRIPTION OF THE PREFERRED EMBODIMENT

Figure 1:
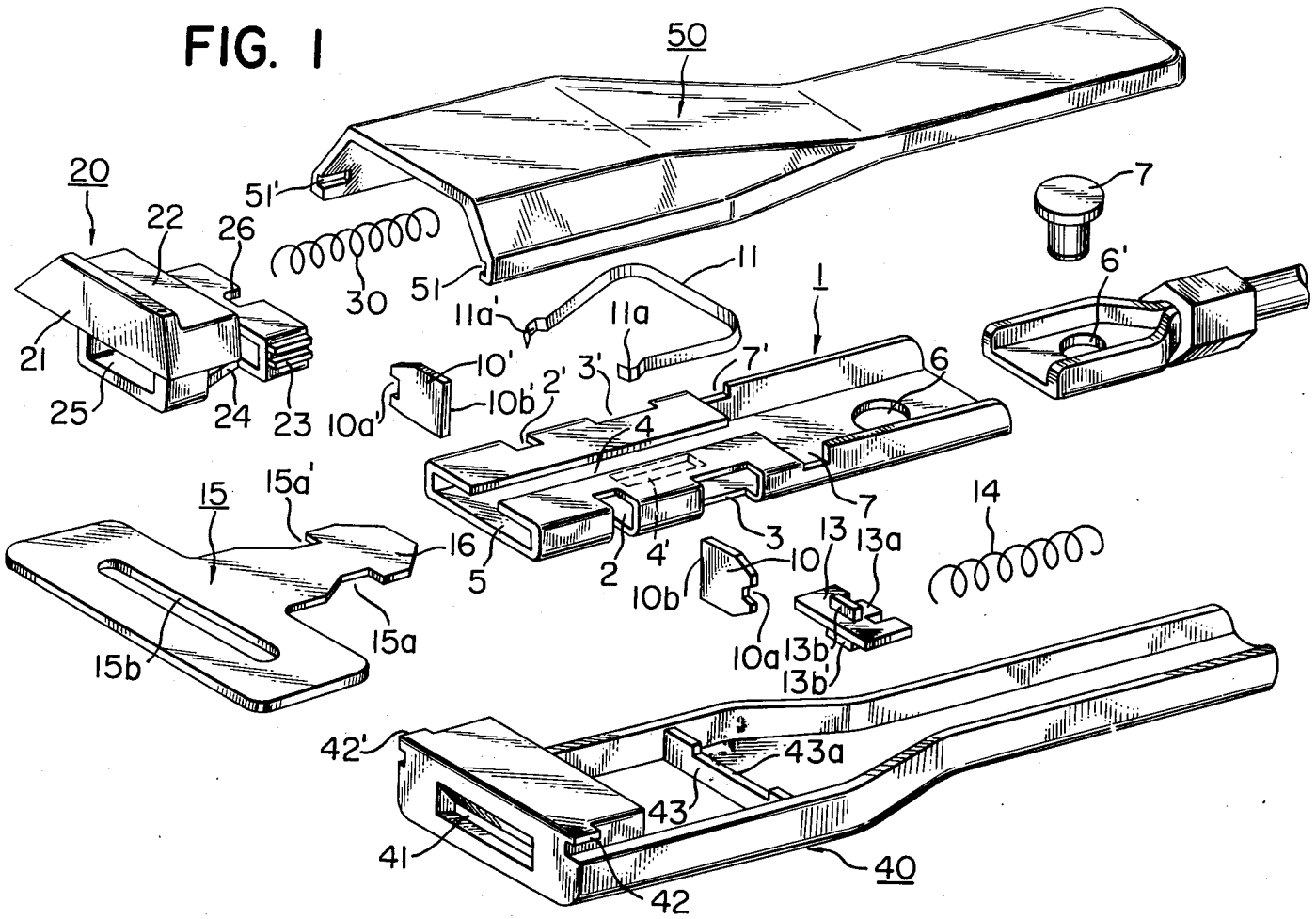
FIG. 1 is an exploded perspective view of an embodiment of the present invention.

Referring to FIG. 1, a base member 1 provided with a substantially rectangular C-shaped cross section in the front half thereof and a U-shaped cross section in the rear half thereof constitutes a pocket 5 in the C-shaped part to accommodate a tongue 15. The base member is provided with notches 2, 2' formed on both sides of the C-shaped part to provide slide paths for plate members 10, 10' and further with notches 3, 3' located behind said notches 2,2' (tongue inlet side being considered the front). The base member supports a bottom portion of a U-shaped spring member 11 provided on the extremities thereof with recessed portions **11*a*, 11*a'* for engagement with outside recesses 10*a*, 10*a'* of the plate members 10, 10' to bias the plate members toward the central longitudinal axis of the pocket part 5. The base member 1 is further provided on the bottom portion of the U-shaped part thereof with a hole 6 so that a rivet 7 may be extended therethrough and through a hole 6' of an element 9 to be fixed to a proper part of a vehicle. The base member 1 may be formed by stamping and bending metal plate, and is provided with upward notches 7, 7'** between the aforementioned C-shaped part and U-shaped part in order to facilitate bending.

In the upper and lower portions of the C-shaped part of the base member 1 and along the center line thereof there are provided guide paths 4, 4' in which there is guided a slider 13 having projections **13*b*, 13*b'* received respectively in the guide paths 4, 4'. Also, the slider is biased in a direction to expel the tongue 15 by means of a coiled spring 14 supported at an end thereof by a rear projection 13*a* on the slider and at the other end thereof by the bottom portion or base of the U-shaped spring 11**.

Figure 2:
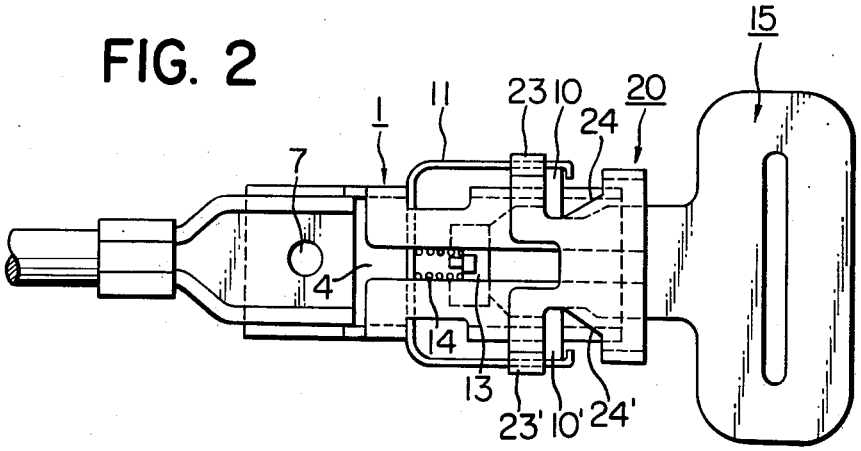
FIG. 2 is a plan view of the embodiment shown in FIG. 1 in the assembled and latched state thereof with the cover and the upper portion of button member removed for clarity in illustration.

In front of the base member 1 there is provided a button member 20 having an upper portion of approximately truncated quadrangular pyramidal shape provided with a slanted front face 21 adapted to be depressed by a finger. The button member has a circular recess for receiving an end of a coil spring 30 and a lower portion is provided with an opening 25 in which the front portion of said C-shaped part of base member 1 is fitted. As shown in FIG. 2, the lower portion of the button member 20 is formed with side cam walls 24, 24' converging toward the rear. The inner extremities **10*b*, 10*b'* of the aforementioned plate members 10, 10' are biased into engagement with the side cam walls 24, 24', respectively, by the force of the spring 11 so that the plate members 10, 10' may slide in the lateral or transversal direction when the button member 20 is moved in the longitudinal direction. The rearmost part of the button member is shaped to encircle the base member 1 and is formed with a notch 26 in the central portion to receive the projections 13*b*, 13*b'* of the slider 13. Guide grooves 23, 23' are formed on both sides of the rearmost part of the button member to guide the spring 11**.

Figure 3:
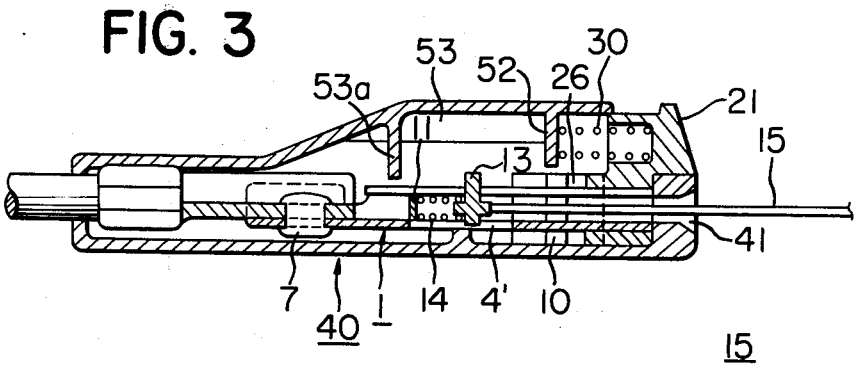
FIG. 3 is a vertical cross-sectional view of the embodiment of FIG. 1 in the assembled and latched state thereof.

The coil spring 30, as shown in FIG. 3, is supported by a transversal rib 52 provided inside the front portion of an upper cover 50 to constantly bias said button member 20 toward the front.

The described inner structure is enclosed in the upper cover 50 and a lower cover 40 which are mutually engaged by means of recesses 51, 51' and projections 42, 42' provided respectively on the frontmost parts of both sides of said covers and which are integrally united by adhering the edges thereof for example by a known thermal treatment. Inside said upper cover 50 there are provided longitudinal ribs 53 between the center line and the sides of said upper cover 50 to support said transversal rib 52 from the back thereof, one of said longitudinal ribs being illustrated in FIG. 3. In the rear portion of said two longitudinal ribs 53 there is further provided a rib 53*a* across the longitudinal ribs to reinforce the upper cover 50. The upper cover is provided at the frontmost part thereof with a trapezoidal inner edge to slidably accommodate the upper portion of the button member 20 and converges toward the rear so as to encircle an end of aforementioned element for supporting the present buckle apparatus. The lower cover 40 is provided with a front portion defining an opening 41 for receiving the tongue 15, and a transversal rib 43 is provided with a notch 43*a* for receiving the base member. The edges of the lower cover converge to the rear behind a parallel portion of a certain length, corresponding to the edges of the upper cover 50.

Now, there will be given an explanation of the function or operation of the structure hereinbefore described.

Upon insertion of the tongue 15 into the buckle through the opening 41, the edges of the tongue widening from the front end 16 thereof cause the plate members 10, 10' to slide outwardly against the biasing force of the spring 11 by the cam walls 24, 24', and the tongue proceeds with corresponding retraction of the slider 13 until the notches 15*a*, 15*a'* provided on the tongue reach the position beyond plate members 10, 10', whereby the plate members are caused to slide toward the center of the pocket 5 by means of the spring 11 to latch the tongue 15 as shown in FIG. 2. FIG. 3 is a vertical cross-sectional view in this state.

Figure 4:
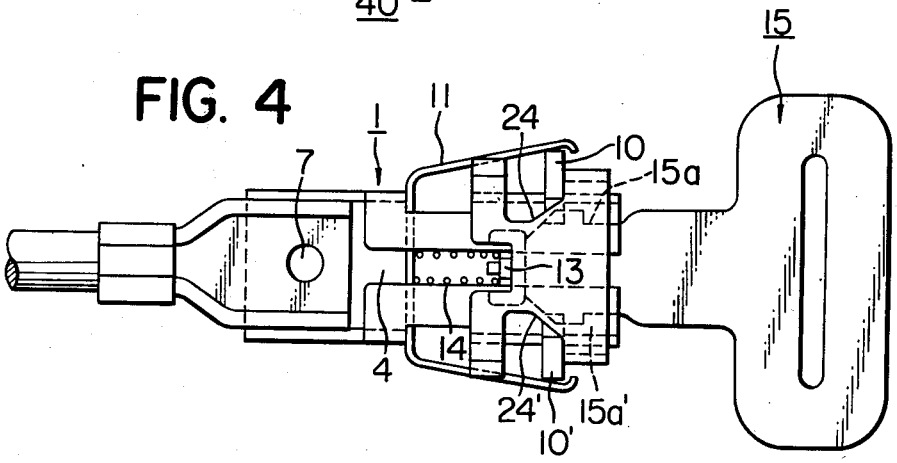
FIG. 4 is a plan view of the embodiment shown in FIG. 1 in the released state thereof with the cover and the upper portion of button member removed for clarity in illustration.

Now, in this state, upon depressing the button member 20 against the biasing force of the coil spring 30 and the spring 11, the plate members 10, 10', as shown in FIG. 4, are projected outwardly by the tapered side walls 24, 24' of the button member 20 to disengage the plate members 10, 10' from the notches 15*a*, 15*a'* of the tongue 15, whereby said tongue 15 is ejected by means of the spring 14.

In this manner the tongue 15 can be easily connected with and disconnected from the buckle apparatus.

The principal advantages achieved by the mechanism of the foregoing embodiment of the buckle apparatus of the present invention are as follows.

In the first place the buckle apparatus of the present invention withstands an elevated load and allows a smooth release operation due to the slidable structure of the latching members. The base member structure obtained by stamping and forming of a comparatively thin plate enables attaining a strength comparable with a thicker metal plate, and further, reduced manufacturing cost is obtainable by continuous pressing of an integral metal piece.

Secondly, in the latched state the plate members 10, 10' are capable of withstanding a larger load without deformation since the force applied to the tongue 15 is received by the surface contact between the plate members 10, 10' and the U-sectioned notches 2, 2' in the base member 1.

Furthermore, the buckle apparatus is featured by easy assembly and easy manipulation, the former of which can be completed, due to the above-mentioned structure of the base member 1, by attaching the covers after the button member 20, the U-shaped spring 11, etc. are previously assembled to said base member 1.

Now a variation of the aforementioned embodiment will be described for improving easy manipulation even in a dark place.

Figure 5:
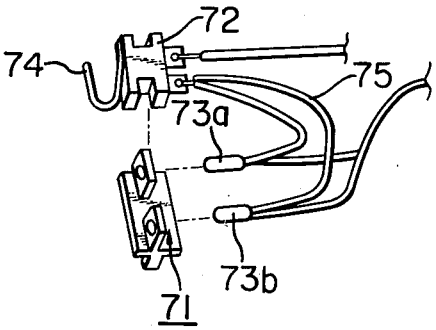
FIG. 5 is an exploded perspective view of an illuminating mechanism in a variation of the present invention.
Figure 6:
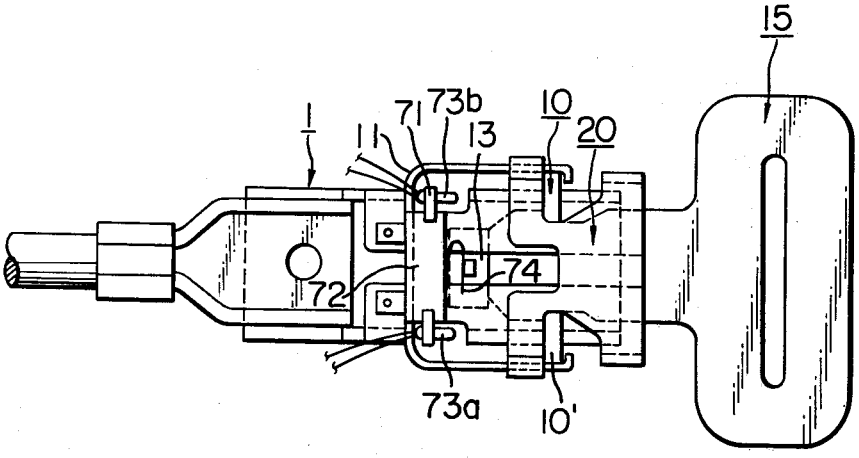
FIG. 6 is a plan view illustrating the function of the variation of FIG. 5 wherein the cover and the upper portion of button member are omitted for clarity in illustration.

As illustrated in FIGS. 5 and 6, a mounting plate 71 is fixed on the upper center of the described base member 1, the mounting plate being formed to support lamps 73*a*, 73*b* and a switch 72. The lamps and switch are connected by means of a lead wires 75 to a power source (not shown). In front of the switch 72 there is provided a projecting contact 74 for contact with the slider 13 (FIG. 6).

The buckle apparatus provided with such illuminating mechanism operates as follows. In the unlatched state or with the tongue 15 disconnected, the slider 13 is positioned out of engagement with the contact 74. In such a state the lamps 73*a*, 73*b* are lighted because the switch 72 is structured to be closed when there is no contact (cf. FIG. 6).

Now in the latched state or with the tongue 50 inserted, the slider 13 is correspondingly retracted to maintain the contact piece 74 in a pressed state. The lamps 73*a*, 73*b* are extinguished in such a state because the switch 72 is structured to be opened in such a state. Such a structure of the switch 72 is well known in the art and need not be explained in detail.

In this manner there is provided a buckle apparatus equipped with lamps which are lighted in the unlatched state and extinguished in the latched state, thus allowing easy manipulation of the buckle apparatus even in a dark place.

It will also be possible, by employing a transparent material around the opening 41, to render this part visible when the lamps are lighted.

It is futther possible to employ for example light-emitting diodes instead of said lamps and also to use such light-emitting means as an indicating means rather than an illuminating means.

The present invention has thus far been explained with respect to the preferred embodiment and the variation thereof, but it is to be understood that the present invention is further subject to various modifications and alterations within the scope and spirit of the appended claims.

What I claim is:

1. A buckle apparatus for safety belt assembly, comprising:

a tongue member having notches on opposite side edges;

a base plate member having a portion of substantially rectangular C-shaped cross section for insertion of the tongue member, and being formed on opposite sides thereof with guide grooves each having supporting surfaces substantially perpendicular to the direction of tongue insertion;

a pair of tongue latching plate members each having a flat surface and being slidable along the respective guide grooves of the base member in a direction substantially perpendicular to the direction of tongue insertion;

biasing means for resiliently urging the tongue latching plate members so that the tongue latching plate members may engage the respective notches of the tongue member and be supported at their said flat surfaces by said supporting surfaces of the guide grooves, when the tongue member is inserted into the base member, to latch the tongue member; and operable means including cam portions for moving the tongue latching plate members against the force of said biasing means in the direction of disengagement from said notches of the tongue member.

2. A buckle apparatus according to claim 1, wherein said biasing means comprises a U-shaped spring whose ends are in contact with said respective latching members.

3. A buckle apparatus according to claim 1, wherein said operable means is slidable in a direction substantially the same as the direction of the tongue insertion.

4. A buckle apparatus according to claim 3, further comprising means for biasing said operable means to a position where said tongue latching members are in the tongue latching position.

5. A buckle apparatus according to claim 1, wherein said base plate member includes an upper plate portion and a lower plate portion.

6. A buckle apparatus according to claim 5, wherein said upper plate portion and lower plate portion are spaced from each other so that said tongue member may be inserted therebetween.

7. A buckle apparatus according to claim 5 or 6 wherein said base plate member is formed of a single metal plate including said upper plate portion and said lower plate portion.

8. A buckle apparatus according to claim 7, wherein said base plate is formed by stamping and forming.

9. A buckle apparatus according to claim 1, further comprising an illuminating means which includes an illuminating lamps and switch means which includes a on-off contact controlled by the insertion of the tongue member.

10. A buckle apparatus according to claim 9, wherein said illuminating lamp is turned on when said tongue member is not inserted and is turned off when said tongue member is inserted.

11. A buckle apparatus according to claim 1, further comprising means for ejecting the tongue member when said tongue member is disengaged from said tongue latching members.

* * * * *